United States Patent [19]

Bertrand et al.

[11] Patent Number: 4,532,510

[45] Date of Patent: Jul. 30, 1985

[54] MEASURING APPARATUS HAVING A SENSOR LOCATED REMOTELY FROM ITS ELECTRICITY POWER SUPPLY

[75] Inventors: Pierre C. Bertrand, Igny; Thijlbert C. De Paepe, Palaiseau, both of France

[73] Assignee: Sereg, S.A., Montrouge, France

[21] Appl. No.: 391,765

[22] Filed: Jun. 24, 1982

[51] Int. Cl.[3] ..... G08C 19/00; G08C 25/02; G08C 19/04

[52] U.S. Cl. ..... 340/870.39; 324/62; 340/870.38; 340/870.42; 340/870.17; 340/870.31

[58] Field of Search ..... 340/870.42, 870.38, 340/870.39, 870.17, 870.31; 324/62

[56] References Cited

U.S. PATENT DOCUMENTS

| | | | |
|---|---|---|---|
| 3,503,261 | 3/1970 | Riester | 340/870.42 |
| 3,530,307 | 9/1970 | Evans | 340/870.31 |
| 3,688,187 | 8/1972 | Loos | 340/870.31 |
| 3,756,081 | 9/1973 | Young | 340/870.31 |
| 3,975,719 | 8/1976 | Frick | 340/870.42 |
| 4,169,243 | 9/1979 | Payne et al. | 324/62 |
| 4,390,879 | 6/1983 | Kimura | 340/870.39 |

FOREIGN PATENT DOCUMENTS

| | | |
|---|---|---|
| 2447629 | 4/1976 | Fed. Rep. of Germany . |
| 1504130 | 3/1978 | United Kingdom . |

*Primary Examiner*—James J. Groody
*Attorney, Agent, or Firm*—Dale Gaudier

[57] ABSTRACT

The measuring apparatus comprises a sensor (11) having a first electrical characteristic (balance of inductance) which is directly modifiable by the magnitude of a quantity or characteristic to be measured (e.g. pressure). A remote electrical power supply (27) excites the sensor over first and second conductors (28, 29) of an electrical link (22) having a second electrical characteristic (e.g. resistance) which is capable of disturbing the measurement. A third conductor (21) in the link is connected to a measuring instrument (24).

In order to avoid measurement errors due to leakage currents in the link, the power supply (27) continuously monitors the electrical characteristics of the link and regulates its excitation output as function thereof and in such a manner as to tend to eliminate disturbing effects on the measurement.

7 Claims, 7 Drawing Figures

MEASURING APPARATUS HAVING A SENSOR LOCATED REMOTELY FROM ITS ELECTRICITY POWER SUPPLY

FIELD OF THE INVENTION

The present invention relates to measuring apparatus, particularly pressure measuring apparatus, including a sensor having an electrical characteristic, eg. inductance, which is modifiable by the quantity to be measured. The sensor is connected via an electrical link to a distant electrical power supply and to distant instrumentation responsive to the modifiable electrical characteristic to display and/or make use of the measured quantity.

Such an arrangement serves to protect the power supply and the instrumentation from sometimes severe temperatures, pressures, and/or radiation to which the sensor is subjected, but it also introduces error in the resulting measurement because of leakage currents in the electrical link.

BACKGROUND OF THE INVENTION

In one known apparatus of this type, the power supply is manually adjusted when the apparatus is installed on site, in order to compensate for the effect of said leakage currents.

However, this adjustment is difficult to perform and is thus a source of inaccuracy in measurement, in addition to requiring action by qualified personel.

Preferred embodiments of the present invention thus provide measuring apparatus of the above type in which there is no need for adjustment when the apparatus is installed on site, in spite of the fact that the leakage currents depend on the length of the electrical link and that this length is unknown when the measuring apparatus is manufactured.

Measuring apparatus is also known in which the sensor acts by varying the value of an electrical resistance, and in which the potential drop due to the link itself is measured in order to compensate the measured result.

This apparatus not only requires an additional conductor for the purpose of measuring said potential drop in the link, but also is only capable of compensating for interference when the electrical characteristic (resistance in this case) which is modified by the quantity to measured is the same as the characteristic giving rise to the interference.

Preferred embodiments of the present invention thus also provide measuring apparatus in which the measurement is based on variation of a first electrical characteristic (eg. inductance) and which are capable of compensating for interference due to a second electrical characteristic (eg. resistance).

SUMMARY OF THE INVENTION

The present invention provides measuring apparatus comprising a sensor having a first electrical characteristic which is directly modifiable by the magnitude to be measured, an electrical link connecting said sensor to a remote electrical power supply and having a second electrical characteristic capable of disturbing the measurement, wherein the apparatus further comprises secondary measuring means responsive at any given moment to the second electrical characteristic of the link plus sensor assembly, and suitable for controlling the power supply as a function of said measured value in order to eliminate the disturbance that would otherwise result therefrom.

This has the effect of ensuring that the sensor is excited under constant conditions regardless of the length or the state the link. Manual adjustment is thus rendered pointless, and furthermore, variation in the state of the link is automatically compensated.

When the sensor and the instrumentation are such that the measurement result is a function of the excitation current passing through the sensor, the secondary measuring means controlling the power supply should be arranged to monitor the total resistance of the link connected in series with the sensor, and to regulate the power supply so that its output voltage is a function of said total resistance and of a predetermined excitation current for the sensor. The current flowing through the sensor is thus kept constant and independent of the state of the link.

When the sensor is AC excited, the total resistance is advantgeously measured using DC. This leads to a particularly simple monitoring and regulation circuit for the power supply and can be used with sensors of simple structure.

When the sensor is a pressure sensor, a center-tapped self inductance can be used as the sensor, with pressure variations altering the balance between the two halves of the inductance. The excitation voltage is then the sum of a first voltage that is directly proportional to the total resistance and a second voltage of constant amplitude and shifted by $\pi/2$ relative to the first.

In this case, since the resistance of the link is much less than the resistance of the sensor, the temperature of the sensor may also be deduced from the monitored value of the total resistance. A single sensor can thus simultaneously provide an accurate pressure measurement and an approximate temperature measurement.

Advantageously, when the link is provided by a shielded cable, capacitative losses due to the shielding are compensated by installing a capacitor at the sensor in series with the measurement conductor.

BRIEF DESCRIPTION OF THE DRAWINGS

An embodiment of the invention is described by way of example with reference to the accompanying drawings, in which.

DETAILED DESCRIPTION

Figure 1:
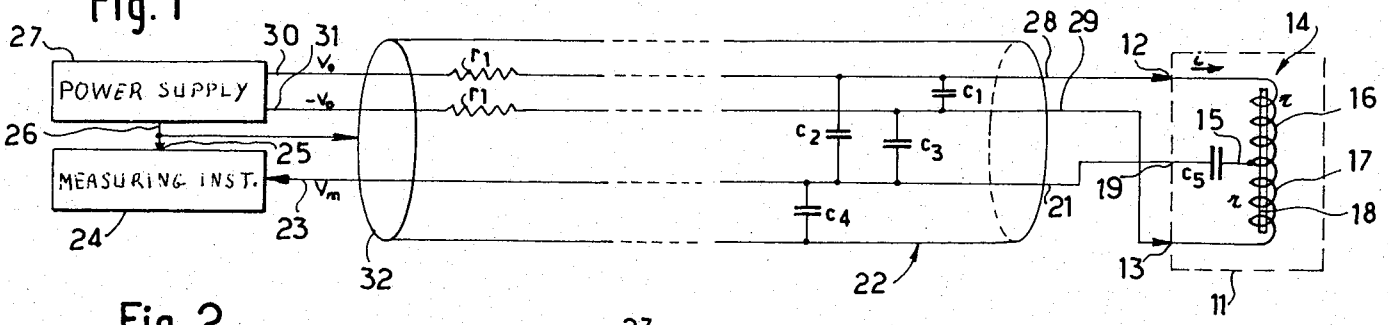
FIG. 1 is a diagram of measurement apparatus in accordance with the invention.

Measuring apparatus in accordance with the invention comprises a pressure sensor 11 (see FIG. 1) located in a measurement location. The sensor 11 has power supply terminals 12 and 13 connected to a coil 14 having a center tap 15 dividing the coil 14 into an upper coil 16 and a lower coil 17.

The upper and lower coils (up and down being with reference only to the drawings) have identical resistance r and respective inductances $l_1$ and $l_2$ which vary as a function of the position of a core 18 which is movable inside the coil 14 under the effect of a varying pressure. The sensor is mounted in a container having a wall with a flexible membrane (not shown) having its inside face linked to the core 18 in such a manner that a fluid whose pressure is to be measured acting on the other face of the membrane causes the core 18 to move.

The center tap 15 is connected to an output terminal 19 of the sensor 11 which is connected by a conductor 21 of a shielded cable 22 to an input terminal 23 of a measuring instrument 24 for measuring the electrical potential $v_m$ applied to its input 23. The measuring instrument 24 also has an input 25 connected to an output 26 of an electrical power supply 27.

The power supply terminals 12 and 13 of the sensor 11 are connected by two further conductors 28 and 29 of the shielded cable 22 to two other output terminals 30 and 31 from the power supply 27 for supplying power to the sensor 11. The cable 22 has electrical shielding 32 connected to the first mentioned output terminal 26 from the power supply 27 that is also connected to the measuring instrument 24.

Figure 6:
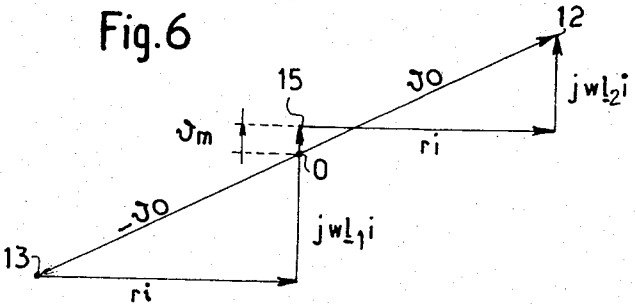

Alternating voltages $v_0$ and $-v_0$ are applied to the outputs 30 and 31 respectively of the power supply 27, and an alternating current i flows through the coil 14. Supposing that the input impedance of the input 23 to the measuring instrument 24 is high enough to ensure that negligible alternating current flows through said input, and that the voltage drops along the line 22 are nil, it is easy to show that the measured voltage $v_m$ is given by the expression:

$$v_m = jw(l_1 - l_2)i \quad (1)$$

such that for constant known current i and voltage $v_0$, the measured voltage $v_m$ is proportional to the value of $l_1 - l_2$, ie. to the position of the core 18 in the coil 14 for small values of linear core displacement, and hence, in well known manner, to the pressure to be measured which is applied to the sensor 11. Expression (1) can be deduced from the vector diagram in FIG. 6, showing the voltages at the coil 14. The diametrically opposed supply vectors $v_0$ and $-v_0$ have a common origin O. Two ohmic drops in the coil are represented by two vectors ri and two inductive voltage drops in the coil are represented by vectors $l_1$wi and $l_2$wi at phase angles that are at 90° to the resistive drop vectors.

However, in fact, the value of the current i is a function of unknown values of resistance $r_1$ of the conductors 28 and 29 and of parasitic capacitances $c_1$ to $C_4$ between the following pairs of conductors: 28 and 29; 28 and 21; 29 and 21; and 21 and 32. Naturally these values of resistance and capacitance are, in fact, distributed along the length of the cable 22, but for clarity in the drawing they are shown as lumped resistors and capacitors.

Figure 2:
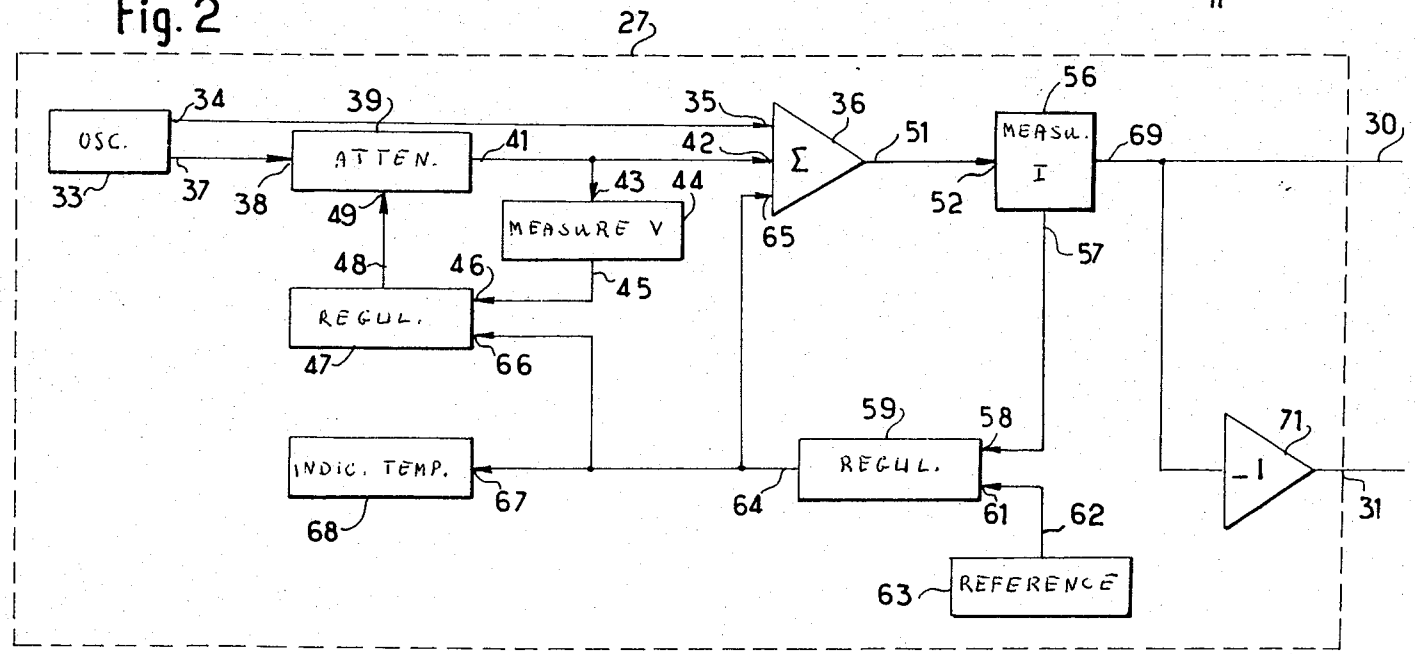
FIG. 2 is a block diagram of a power supply for use in the apparatus of FIG. 1.

The measuring apparatus is provided with means to eliminate the interference effects of these resistances and capacitances, whose values depend on the length of the cable 22 which length is unknown at the time the measuring apparatus is manufactured. This is done without resorting to manual adjustment on site. FIG. 2 is a block diagram of the power supply 27, and shows an oscillator 33 having a first output 34 connected to a first input 35 of a three input summing circuit 36, and a second output 37 connected to the signal input 38 of a variable attenuator 39. The attenuator 39 has a signal output 41 connected both to the second input of the summing circuit 36 and to a sense input of an AC measuring circuit 44 for measuring the amplitude of the alternating voltage of the signal applied to its sense input. The AC measuring circuit 44 has a measurement output 45 connected to a first control input 46 of a first regulator 47 whose output 48 is applied to the control input 49 of the attenuator 39.

The summing circuit 36 has a sum output 51 connected to the current input terminal 52 of a DC measuring circuit 56 for measuring direct current. The measuring circuit 56 has a measurement output 57 connected to a first control input 58 of a second regulator 59 which has a second control input 61 connected to the output 62 of a reference value generator 63. The second regulator 59 has an output 64 which is connected to the third input 65 of the summing circuit 36, to a second control input 66 of the first regulator 47, and to the input 67 of a temperature indicator 68.

The DC measuring circuit 56 has a current output terminal 69 via which the measured current from the output 51 of the summing circuit 36 leaves the DC measuring circuit. This current is applied directly to a first output terminal 30 of the power supply, and via an inverter 71 to its second output terminal 31, thereby supplying the said voltages $v_0$ and $-v_0$.

Figure 3:
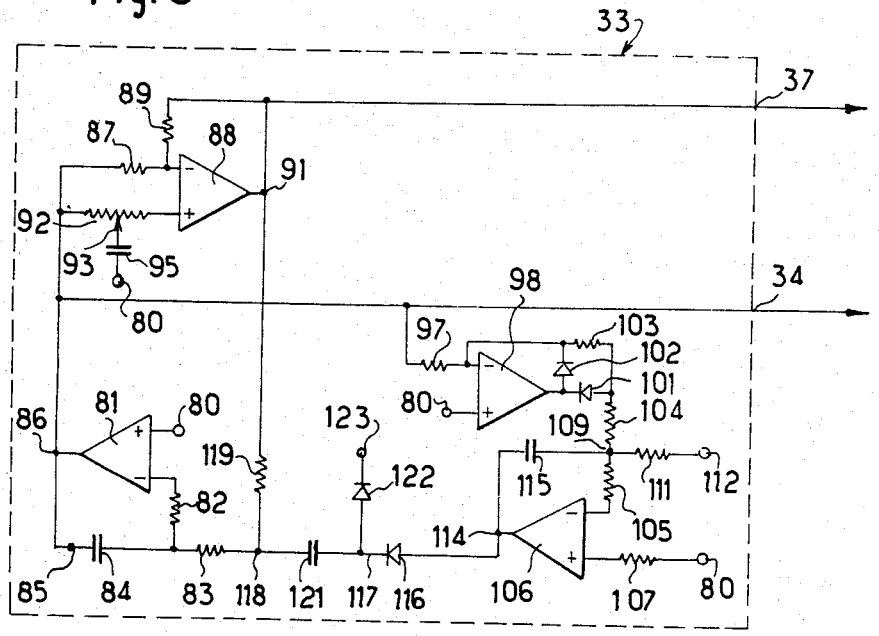
FIGS. 3 to 5 are circuit diagrams of portions of the apparatus.

FIG. 3 is a circuit diagram of the oscillator 33 which comprises four operational amplifiers: first and second operational amplifiers 81 and 88 which are connected to constitute the oscillator as such, and which provide a first alternating output signal on the first output 34 and a second alternating output signal shifted by $\pi/2$ relative to the first on the second output 34; a third operational amplifier 98 connected to provide a DC measurement signal proportional to the amplitude of the AC signal output; and a fourth operational amplifier connected to regulate the amplitude of the oscillator output signal.

The first operational amplifier 81 has its non-inverting input is connected to receive a DC reference voltage present on a reference voltage terminal 80. The reference voltage may be 10 V for example, and corresponds to the point O in FIG. 6. The inverting input of the amplifier 81 is connected via a resistor 82 to a point which is common to a resistor 83 and a capacitor 84. The other terminal 118 of the resistor 83 is referred later on. The other terminal 85 of the capacitor 84 is connected to the output 86 from said first operational amplifier 81. This point is also connected to the first output 34 from the oscillator 33 as a whole, and via a resistor 87 to the inverting input of the second operational amplifier 88.

This inverting input is connected to the output 91 of the amplifier 88 via a negative feedback resistor 89. The output 91 is also connected to the second output 37 from the oscillator 33 as a whole, and via a resistor 119 to said other terminal 118 of the resistor 83. The non-inverting input of the amplifier 88 is connected to the output 86 from the first operational amplifier 81 via the resistance of a potentiometer 92 having an adjustable point 93 connected via a capacitor 95 to the reference voltage terminal 80.

The output 86 from the first operational amplifier 81 is additionally connected via a resistor 97 to the inverting input of the third operational amplifier 98 whose non-inverting input is directly connected to the reference voltage terminal 80. The output from the third operational amplifier 98 is connected to the cathode of a first diode 101 and to the anode of a second diode 102. The cathode of the second diode 102 is connected directly to the inverting input of the amplifier 98 and via a resistor 103 to the anode of the first diode 101. The anode of the first diode 101 is also connected via a two resistors 104 and 105 connected in series to the inverting input of the fourth operational amplifier 106 having a non-inverting input connected via a resistor 107 to the reference voltage terminal 80. The common point 109 between the resistors 104 and 105 is connected via a resistor 111 to a DC bias voltage source 112, at a potential of 12.5 V for example.

The output 114 of the fourth operational amplifier 106 is connected both to said common point 109 via a capacitor 115, and to the anode of a third diode 116 whose cathode 117 is connected via a capacitor 121 to the said other terminal 118 of the resistor 83, which is also connected to the output 91 from the second operational amplifier 88 via the resistor 119.

The cathode 117 of the third diode 116 is also connected to the anode of a fourth diode 122 whose cathode is connected to a source 123 of DC, eg. at a potential of 20 V.

Figure 4:
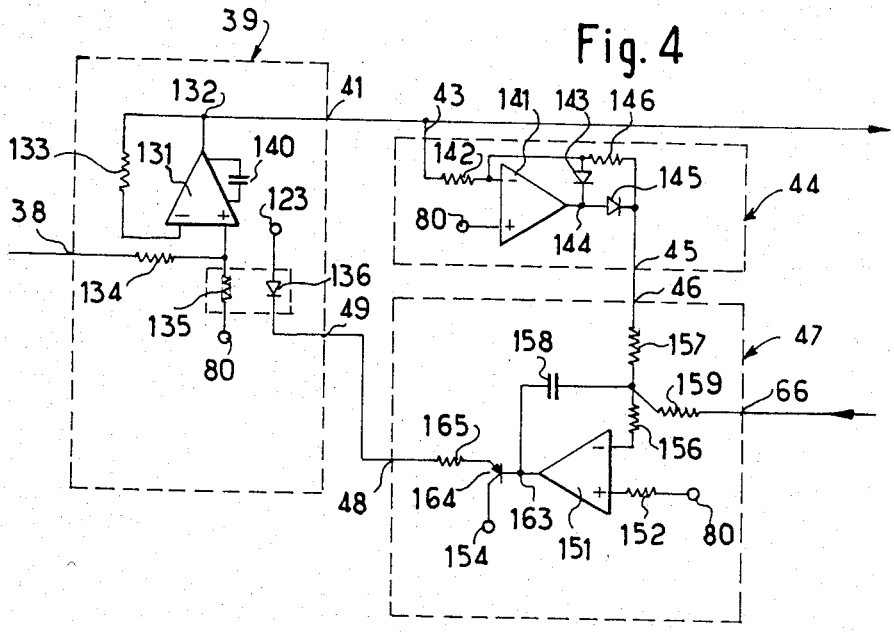

FIG. 4 is a circuit diagram of the variable attenuator 39, the DC measurement circuit 44 and the first regulator 47. The attenuator 39 comprises a single operational amplifier 131 which is stabilized by a capacitor 140, and which has its inverting input connected to its output 132 by a negative feedback resistor 133. The output 132 constitutes the output 41 of the attenuator 39 as a whole. The non-inverting input of the amplifier 131 is connected via a resistor 134 to the input 38 of the attenuator as a whole, and via a light sensitive resistance 135 to the reference voltage terminal 80. The light sensitive resistance 135 is housed opposite to a light emitting diode (LED) 136 whose anode is connected to the DC terminal 123 and whose cathode constitutes the control input 49 of the attenuator 39.

The AC measuring circuit 44 comprises a single operational amplifier 141 connected in the same manner as the third operational amplifier 98 of the oscillator 33. Its inverting input is connected both to the sense input 43 of the AC measuring circuit 44 via a resistor 142, and to cathode of a first diode 143 whose anode is connected to the output 144 of the amplifier 141. The output 144 is also connected to the anode of a second diode 145 whose cathode is connected to the output 45 of the AC measuring circuit 44 and to the anode of the first diode 143 via a resistor 146. The non-inverting input of the amplifier 141 is connected to the DC reference voltage terminal 80.

The regulator 47 comprises a single operational amplifier 151 together with resistors 152, 159, 156, and 157, and a capacitor 158, connected in the same manner as the fourth operational amplifier 106, the resistors 107, 111, 105 and 104 respectively, and the capacitor 115, of the oscillator 33.

The other terminals of the resistors 152, 159 and 157 are respectively connected to the reference voltage terminal 80, the second input terminal 66, and the first input terminal 46.

The output 163 of the operational amplifier 151 is connected to the base of a PNP type transistor 164 whose collector is connected to receive a DC voltage 154 (eg. 0 V) and whose emitter is connected via the output 48 of the first regulator 47 and the input 49 of the variable attenuator 39 to the anode of the LED 136.

Figure 5:
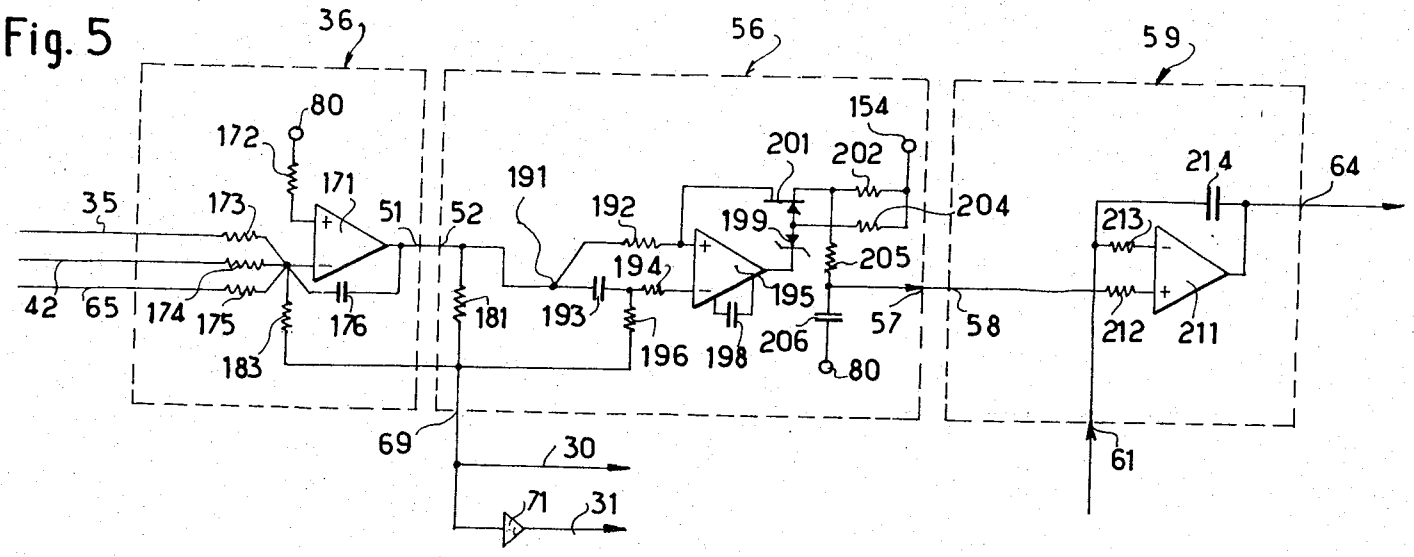

FIG. 5 is a circuit diagram of the summing circuit 36, the DC measuring circuit 56 and the second regulator 59. The summing circuit 36 comprises a single operational amplifier 171 having its non-inverting input connected via a resistor 172 to the reference voltage terminal 80. Its inverting input is connected via a feedback capacitor 176 to its output which also constitutes the output 51 of the summing circuit, and via respective resistors 173, 174 and 175 to the first, second, and third inputs 35, 42 and 65.

The DC measuring circuit 56 comprises a single operational amplifer 195. The circuit 56 has a current sensing resistor 181 whose terminals constitute the current output terminal 69 and the current input terminal 52 which is connected to the output 51 from the summing circuit 36. The current output terminal 69 is connected via a resistor 183 of much higher resistance than $r+r_1$ to the inverting input of the summing circuit amplifier 171. The current input terminal 52 is also connected to the common point 191 between a resistor 192 and a capacitor 193. The other end of the resistor 192 is connected to the non-inverting input of the operational amplifier 195, while the other end of the capacitor 193 is connected both to the inverting input of the amplifier 195 via a resitor 194 and to the current output terminal 69 via a resistor 196.

The amplifier 195 is stabilized by a capacitor 198. Its output is connected to the cathode of a zener diode 199 whose anode is connected to the gate of a field effect transistor (FET) 201. The drain of the FET is connected to the non-inverting input of the amplifier 195 and the source of the FET is connected via a resistor 202 to the voltage source 154 (eg. 0 V). The gate of the FET is also connected to the source 154 via a resistor 204.

The source of the FET is further connected via a resistor 205 to the measurement output 57 of the DC measuring circuit 56. This output 57 is also connected via a capacitor 206 to the voltage reference terminal 80.

The regulator 59 comprises a single operational amplifier 211 whose non-inverting input is connected via a resistor 212 to the first input 58 to the regulator 59. The inverting input of the amplifier 211 is connected via a resistor 213 to the second input 61 which ia also connected via a capacitor 214 to the output of the amplifier 211 which also constitutes the output 64 from the regulator as a whole.

The apparatus which has just been described operates as follows:

The oscillator 33 generates an alternating voltage of fixed stabilized amplitude at at its output 34. This voltage serves as a phase reference for the alternating voltage applied to the other output 37 which is shifted by $\pi/2$ from the stabilized voltage.

The amplitude of the voltage applied to the other output 37 is not specifically fixed, but it is nonetheless fairly constant. It is modulated by the attenuator 39 as a function of the result of a comparison between the voltage measured at the output of the attenuator 39 and a voltage which is proportional to the total resistance of the conductor 28, the coil 14, and the conductor 29.

Thus the signals on the first and second inputs 35 and 42 of the summing circuit 36 give rise to a coil exciting signal on its output 51 of the form:

$$v_0 = jwLi/2 + (r_1 + r)i \qquad (2)$$

where L is a constant representative of the inductance of the coil.

Further, the voltage across the terminals 12 and 13 of the sensor 11 has the form:

$$v' = 2v_0 - (2r_1 i + r_1 i_c) \qquad (3)$$

where $i_c$ is the leakage current flowing through the capacitances $C_1$, $C_2$, and $C_3$.

Since the leakage current $i_c$ is much less than the current i, and since the resistance of the line $r_1$ is much less than the resistances 2r of the coil 14, the product $2ri_c$ obtain:

$$v' = (jwL + 2r)i \quad (4)$$

which shows that the current flowing through the coil 14 is a function solely of the characteristics of the coil and is independent of the electrical characteristics of the line 22.

To measure the total resistance of the line 22 and the sensor 11, use is made of the DC voltage appearing at the output 64 of the second regulator 59, taking advantage of the fact that while the oscillator 33 is generating an alternating voltage, eg. at 300 Hz, AC and DC conditions are superposed in the link 22 and the sensor 11.

The DC current flowing in order through the conductor 28, the coil 14 and the conductor 29 is measured by virtue of the current sensing resistor 181 and the amplifier 195. Its measured value is compared by the second regulator 59 with a value set by an adjustable reference value generator 63, whose value is set by a potentiometer, for example. The regulator loop is completed by the summing circuit 36.

Thus, the output 69 behaves as a current source at DC and as a voltage source at the AC frequency in use, while the output from the alternating voltage inverter 71 behaves as a voltage source.

At the same time, the output value from the second regulator 59 which is a measure of the total resistance of the line 22 and the coil 14, is applied both to the second input 66 of the first regulator 47 to enable it to control the attenuator 39, and also to the temperature indicator 68.

Since the line resistance $r_1$ is very small compared with the resistance 2r of the coil 14, any variation in the total resistance of the line 22 and the coil 14 is a first approximation to variation in the resistance of the coil 14 alone, ie. to the variation due to the temperature of the sensor 11.

The link cable 22 causes further interference to measurement due to the parasitic capacitance $C_4$ between the conductor 21 and the cable shielding 32. To eliminate the effects of the corresponding leakage current i' which is distributed along the cable 22, a capacitor $C_5$ is advantageously disposed inside the sensor 11 in between the center tap 15 and the terminal 19. The capacitance of the capacitor $C_5$ is chosen such that $lC_5w^2 = 1$, where w is the angular frequency of the voltage supplied to the sensor 11 and where $l = (l_1 + M)/2$ in which M is the value of the mutual inductance between the coil portions 16 and 17.

Figure 7:
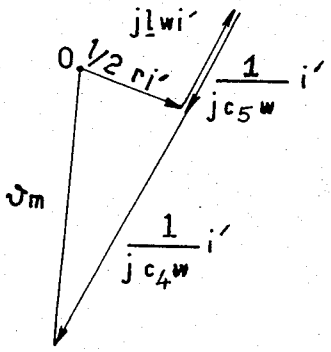
FIGS. 6 and 7 are vector diagrams.

FIG. 7 is a vector diagram showing the voltages between the conductor 21 and the shielding 32. This diagram shows: the measurement voltage $v_m$ as a reference vetor; a first vector ri'/2 corresponding to the ohmic drop in the coil portion 16 and shifted by an angle of slightly less than $\pi/2$ relative to the measurement voltage $v_m$; a second vector jlwi' corresponding to the inductive voltage drop in the coil 14 and shifted by $\pi/2$ relative to the first vector; and third and fourth vectors corresponding to the capacitive voltage drops due to the capacitances $C_4$ and $C_5$ in phase opposition to the inductive second vector.

It can be seen that the inductive voltage drop due to the inductance l of the coil 14 is cancelled by the capacitive drop due to the capacitor $C_5$ (supposing that a suitable value is chosen for $C_5$) whereby the voltage received at the input 23 to the measuring instrument 24 is not affected to a first approximation by the current i'.

We claim:

1. Apparatus for measuring a physical characteristic comprising a sensor having a first electrical characteristic which is directly modifiable by and representative of the physical characteristic to be measured, an electrical link comprising two conductors connecting said sensor to a remote electrical power supply and a third conductor connecting the sensor with means for measuring the electrical characteristic which is representative of the measured physical characteristic, the link having a second electrical characteristic capable of disturbing the measurement made by the sensor, wherein the apparatus further comprises secondary measuring means located proximate the power supply responsive at any given moment to a measured value of the second electrical characteristic of the link plus sensor assembly for controlling the power supply as a function of said measured value in order to eliminate the disturbance that would otherwise result therefrom.

2. Apparatus according to claim 1, wherein the first electrical characteristic is inductance and the second electrical characteristic is resistance.

3. Apparatus according to claim 1, wherein the sensor has an output which is a function of an exciting electrical current (i) passing through the sensor, and wherein the secondary measuring means determines the total resistance $(2r + 2r_1)$ of the link and the sensor, and controls the power supply in such a manner as to cause it to generate a voltage $(2v_0)$ which is a function of the total resistance of the link and sensor and a predetermined value of excitation current.

4. Apparatus according to claim 3, wherein the sensor is excited with AC and wherein the total resistance is measured by means of DC.

5. Apparatus according to claim 4, wherein the sensor is an induction bridge powered by an excitation voltage which is the sum of a first voltage which is directly proportional to the total resistance of the link and sensor, and a second, fixed voltage which is shifted by $\pi/2$ relative to the first voltage.

6. Apparatus according to claim 1, wherein a capacitor is connected in series between the sensor and the third conductor to compensate for leakage current induced by parasitic capacitance present in the link.

7. Apparatus according to any one of claims 3 to 5, wherein the temperature of the sensor is deduced from the measured total resistance.

* * * * *